US007223098B2

(12) United States Patent
Suyama et al.

(10) Patent No.: US 7,223,098 B2
(45) Date of Patent: May 29, 2007

(54) IGNITION UNIT

(75) Inventors: Hideya Suyama, Kobe (JP); Atsushi Yoshimoto, Akashi (JP); Kozo Uehara, Kakogawa (JP); Masaaki Kumon, Kobe (JP); Satoshi Nakai, Miki (JP); Kazuya Kawauchi, Kakogawa (JP); Takuji Saiki, Kakogawa (JP); Shingo Kimura, Kakogawa (JP); Naomi Tanaka, Akashi (JP)

(73) Assignee: Noritz Corporation, Hyogo (JP)

( * ) Notice: Subject to any disclaimer, the term of this patent is extended or adjusted under 35 U.S.C. 154(b) by 272 days.

(21) Appl. No.: 10/911,167

(22) Filed: Aug. 4, 2004

(65) Prior Publication Data

US 2005/0042564 A1 Feb. 24, 2005

(30) Foreign Application Priority Data

Aug. 22, 2003 (JP) ..... 2003-299301
Jan. 30, 2004 (JP) ..... 2004-022522
Jun. 2, 2004 (JP) ..... 2004-165051

(51) Int. Cl.
*F23Q 3/00* (2006.01)
*F23Q 7/08* (2006.01)
*F23D 14/46* (2006.01)

(52) U.S. Cl. ..... 431/343; 431/264; 431/259

(58) Field of Classification Search ..... 431/264, 431/343, 258, 259; 439/552, 557; 313/118, 313/144, 324, 323, 135; 248/229.14
See application file for complete search history.

(56) References Cited

U.S. PATENT DOCUMENTS 3,589,846 A * 6/1971 Place et al. ..... 431/29
4,266,841 A * 5/1981 Sherwood ..... 439/312
5,498,154 A * 3/1996 Velie et al. ..... 431/264
6,123,579 A * 9/2000 Ping ..... 439/557
6,231,385 B1 * 5/2001 Kuo ..... 439/557
6,435,916 B1 * 8/2002 Amberg et al. ..... 439/651

FOREIGN PATENT DOCUMENTS

JP 1-8859 3/1989
JP 2001-248838 9/2001

* cited by examiner

*Primary Examiner*—Josiah Cocks
*Assistant Examiner*—Sarah E. Suereth
(74) *Attorney, Agent, or Firm*—Jordan and Hamburg LLP

(57) ABSTRACT

An ignition unit promotes the efficiency of assembly because connections on the high voltage output side and the ground side are completed by a single operation, when an ignition electrode part and a main unit are connected together directly. A guide rail of the main unit is insertion-engaged into a slit between clamp pieces of a bracket so that the main unit is mounted onto the bracket. With the insertion engagement, a high voltage output terminal receives therein a high voltage input terminal of a spark plug supported by the bracket, a plate terminal which is a part of the bracket is driven into a ground-side connection terminal, and a convex portion of a projected piece is engaged into an engagement hole, for positioning and slipping-off prevention.

15 Claims, 8 Drawing Sheets

IGNITION UNIT

BACKGROUND OF THE INVENTION

1. Field of the Invention

The present invention generally relates to an ignition unit for igniting the burner of a burning appliance (e.g., a water heater, a heating apparatus et cetera) which makes utilization of the combustion of liquid fuel (e.g., kerosene) or gas fuel (e.g., gas). This invention relates more particularly to an ignition unit which is configured such that fuel, blown out from the burner, is ignited by a spark discharge from an ignition electrode and is burned.

2. Description of the Related Art

Such a type of ignition unit is called the "ignitor". One such example of the ignition unit of this type has been known in the art, which is comprised of an ignition electrode capable of generation of spark discharges and a transformer mounted in the inside of a casing. The transformer receives a supply of electric power from a commercial power source and then voltage-transforms it into a high voltage for discharge at the ignition electrode, and the transformer and the ignition electrode are connected together so that an electric current of such a high voltage flows to the ignition electrode (see Japanese Utility Model Kokoku Pub. No. 1989-8859).

In addition, there is proposed another example of the above-described ignition unit which is characterized in that the connection between a high voltage output part on the casing side and an ignition electrode is established when the former is inserted into the latter (see Japanese Patent Kokai Pub. No. 2001-248838). In this prior art technique, the casing-side high voltage output part is formed by a pair of elastic plates which are in elastic contact with each other. And, a plate-like connection part of the ignition electrode on the base end side thereof is inserted between these elastic plates and, as a result of such insertion, the connection part is held firmly between the pair of elastic plates.

SUMMARY OF THE INVENTION

And now, generally the casing is formed of synthetic resin. An electronic component for generation of high voltages is disposed in the inside of the casing while on the other hand the ignition electrode is disposed near the burner. And, fuel blown out of the burner towards the combustion chamber is ignited by a spark discharge from the ignition electrode and combustion starts. Accordingly, in a burning appliance such as a water heater and the like, the ignition electrode constituting an ignition unit is disposed at a position where the ignition electrode is exposed to the burning chamber and therefore receives heat of combustion directly therefrom, in other words at a position inside the burner case, while on the other hand the casing is disposed at a position outside the burner case so that it will not receive heat of combustion directly from the burning chamber. Consequently, the ignition unit is assembled after an operation of connecting together the ignition electrode and the casing housing therein the electronic component for high-voltage generation and assembly operations such as individual fixing operations.

Conventional ignition units, however, have the following various drawbacks. In the first place, it is required that, in addition to the connection of the ignition electrode to the high voltage output part of the casing, the conductive connection to the casing side be established with respect to the ground side for spark discharges from the ignition electrode. In the second place, even when the connection between the ignition electrode and the high voltage output part of the casing is established not by a cord but by direct mechanical joint as proposed in the aforesaid patent document (2001-248838), it is required that, in order to prevent the occurrence of a relative displacement between the ignition electrode and the casing housing therein the high voltage output part, they must be united together strongly as a single piece. In the third place, in the case of employing a technique in which the ignition electrode and the casing are not united together but are just connected together and they are individually fixed to the burner case or the like by screws or other fixing means, such fixing operations make the assembly of an ignition unit extremely complex. In the fourth place, it must be arranged such that excessive thermal influence by heat of combustion from the side of the burner case is prevented from acting on the casing at the time of the unification or fixation. In the fifth place, when establishing the connection between the ignition electrode and the high voltage output part of the casing by an insertion operation, this requires a structure capable of guaranteeing that the ignition electrode and the high voltage output part are connected together definitely because of the flow of a high voltage electric current. Finally, in the case where the ignition electrode being located in the vicinity of the burner and the high voltage output part of the casing are brought into direct connection with each other, accordingly, the connection area is situated near the burner case, therefore producing the requirement that the occurrence of leakage of a high voltage (for example, spark leak) from the edge of the connection area be avoided.

Bearing in mind the above-described drawbacks, the present invention was made. Accordingly, an object of the present invention is to provide an ignition unit capable of eliminating the aforesaid various drawbacks.

In order to achieve the above-described object, the present invention provides an ignition unit comprising: a bracket which is fixed to a dividing wall constituting a part of an ignition target; a spark plug which is supported by the bracket so as to penetrate through the dividing wall and which ignites the ignition target by a spark discharge; and a main unit which has a housing containing therein a high voltage output part for the spark discharge and which is mounted onto the bracket, wherein: the bracket is made of an electrically conductive material so as to constitute, together with the dividing wall, a part of a ground-side circuit from the ignition target which has received a spark discharge from the spark plug; the spark plug projects to near the ignition target so that an ignition electrode part on the side of a leading end is able to issue a spark discharge to the ignition target at a position on one side through the bracket; the spark plug is supported by the bracket so that a high voltage input terminal on the side of a base end projects in a predetermined direction at a position on the other side through the bracket; and the main unit has a high voltage output terminal which is connected to the high voltage output part and which projects outwardly and a ground-side connection terminal which projects in parallel with the high voltage output terminal. And, the housing of the main unit and the bracket have sections respectively integrally formed therewith, these sections together constituting a mount mechanism for guiding an insertion operation and for holding a conductive connection state in order that both the conductive connection of the high voltage output terminal to the high voltage input terminal and the conductive connection of the ground-side connection terminal to the bracket can be established by insertion engagement of the main unit into the bracket in the projecting direction of the high voltage output terminal and the ground-side connection terminal.

In the case of this invention, with the bracket fastened to the dividing wall of the ignition target by for example screws or the like, the spark plug is supported by the bracket, and the ignition electrode part is located on the side of the ignition target interior to the dividing wall while on the other hand the high voltage input terminal is located outside the dividing wall. Both the conductive connection of the high voltage output terminal on the main unit side with respect to the high voltage input terminal of the spark plug on the bracket side and the conductive connection of the ground-side connection terminal on the main unit side with respect to the bracket are completed simultaneously by carrying out a single insertion engagement operation of inserting the main unit into the bracket from the aforesaid projection direction, i.e., from a certain direction. At the time of such an insertion engagement operation, the mount mechanism ensures that the direction of insertion and the progress of insertion are guided. Besides, it is further ensured that the aforesaid conductive connections are maintained once the mounting operation is completed. Stated another way, it is possible to unite together the main unit and the bracket supporting thereon the spark plug by assembling by direct connection without an intervention (e.g., a high voltage cord), such as by an assembly operation by the conductive connection between the high voltage output terminal and the high voltage input terminal and the conductive connection between the ground-side connection terminal and the bracket. And, since the mount mechanism ensures that the aforesaid insertion engagement is guided, this makes it possible to not only facilitate the foregoing assembly operation but also ensure the execution thereof. And, in a state in which the main unit is mounted onto the bracket by the aforesaid insertion engagement operation, a predetermined high voltage is applied, through the high voltage output terminal and the high voltage input terminal, to the ignition electrode part from the high voltage output part and, as a result, a spark discharge is shot to the ignition target such as the burner or the like. Upon receipt of the spark discharge, fuel from the ignition target is ignited and combustion starts. On the other hand, conduction to the ground-side connection terminal is established from the ignition target in receipt of the spark discharge through the ground-side connection circuit made up of the dividing wall (such as the burner case and so on) and the bracket fixed to the dividing wall.

In accordance with the present invention, more preferable working effects will be obtained by addition of the following specific particulars and by giving more detailed specifics.

In the first place, it is possible that the housing of the main unit and the bracket have sections respectively integrally formed therewith, wherein the sections together make up a lock mechanism for locking the main unit and the bracket in a mount state established by the mount mechanism. And, the lock mechanism has a convex portion which is formed in one of the housing of the main unit and the bracket and which projects in a direction orthogonal to the direction of the insertion engagement, and a concave portion which is formed in the other of the housing of the main unit and the bracket and into which the convex portion is engaged from the direction orthogonal to the insertion engagement direction, and the convex and concave portions are arranged so that the convex portion reaches a position of engagement into the concave portion by the insertion engagement, and that the convex portion is placed in a state in which the convex portion is engaged into the concave portion with the main unit mounted onto the bracket by the mount mechanism. By virtue of the addition of such a lock mechanism, a state in which the main unit is mounted onto the bracket is established, in other words the high voltage output terminal and the high voltage input terminal are brought into conductive connection with each other, and, in addition, the ground-side connection terminal and the bracket are brought into conductive connection with each other, is maintained more reliably. Stated another way, since the convex portion forming the lock mechanism is engaged, relative to the direction orthogonal to the insertion engagement direction, into the concave portion, this prevents the relative displacement of the main unit to the bracket with respect to all the plane directions orthogonal to the direction in which the convex portion is engaged into the concave portion. As the result of this, besides the positioning of a mount fixation position with respect to the insertion engagement direction and the slipping-off prevention of the main unit, it is possible to strongly hold the mount state of the main unit by preventing the occurrence of displacement of the main unit with respect to other directions, thereby making it possible to strongly unit together the main unit and the bracket. In other words, by virtue of the addition of the lock mechanism, it is ensured that the mount fixation position of the main unit is determined reliably in an operation of mounting the main unit onto the bracket. In addition, after the mounting of the main unit, the main unit is fixed in a slipping-off prevention manner. The mount state of the main unit is held more strongly and, as a result, the main unit and the bracket are united together strongly.

In the above-described lock mechanism, the concave portion is an engagement hole which is formed so as to penetrate through the bracket; the convex portion is formed at a leading end side portion of a projected piece which extends and projects from the housing of the main unit in the same direction as the high voltage output terminal; and the projected piece is configured so that an elastic pressing force acts in a direction in which the convex portion is engaged into the engagement hole. By the application of an elastic pressing force from the projected piece, it becomes possible to ensure that the lock state in which the convex portion is engaged into the engagement hole is maintained definitely and, in addition, there is established a state in which elastic pressing force acts against the bracket from the side of the main unit, thereby making it possible to reinforce the unification of the main unit and the bracket to a further extent.

In the second place, it is possible that the mount mechanism is provided with a guide rail which projects from an outer surface of the housing of the main unit and which extends in parallel with the insertion engagement direction, and a clamp piece which is formed in the bracket so as to slide in the insertion engagement direction along over the housing's outer surface with the guide rail clamped by the clamp piece. In this case, a more concrete structure serving as the mount mechanism is specified. And, an insertion engagement operation is carried out in which either the main unit or the bracket is slid along over the housing's outer surface in the direction in which the guide rail extends, i.e., in the insertion engagement direction, with the main unit-side guide rail clamped by the bracket-side clamp piece. Because of this, the direction of an insertion operation is determined automatically and, in addition, it is ensured that the insertion operation is guided by the sliding of the main unit or the bracket being slid along over the housing's outer surface, with the guide rail clamped by the clamp piece. Therefore, the process up to the mount operation is guided without fail. In this case, the number of guide rails may be one, two, three or more. Additionally, as the clamp piece for clamping guide rails, a single clamp piece having a specific cross-sectional shape may be used. Alternatively, the guide rails may be clamped between end edges of two or three flat plate-like clamp pieces.

In addition, it may be arranged such that the guide rail is provided with a concave groove which opens at a side surface of the guide rail and which extends in a straight line along the guide rail, and that an end edge of the clamp piece which extends in the insertion engagement direction is engaged into the concave groove. By performing an insertion engagement operation with the end edge of the clamp piece engaged into the concave groove of the guide rail, it becomes possible to mount the main unit onto the bracket in such a restricted state that there occurs no displacement with respect to all of the orthogonal triaxial direction. This makes it possible to more strongly and highly realize the unification of the main unit and the bracket.

Furthermore, it may be arranged such that the housing of the main unit is provided with two guide rails while on the other hand the bracket has a central clamp piece which is inserted between the two guide rails and two outer clamp pieces which are arranged outside the two guide rails respectively, and that the central clamp piece is arranged so that, when the main unit is mounted onto the bracket, the guide rails are clamped between the central clamp piece and each of the outer clamp pieces, with the central clamp piece spaced apart from the outer surface of the housing so as to define a space therebetween. In this case, it becomes possible for the central clamp piece to shield the housing's outer surface, with a layer of air intervened between the housing's outer surface and the central clamp piece. Accordingly, even when, with the combustion of the ignition target, radiation heat is received from the dividing wall of the ignition target to which the bracket is fixed, it becomes possible to suppress thermal influence on the main unit as much as possible by heat reflection by the central clamp piece and heat insulating action by the air layer. Because of this, the durability of the main unit whose housing contains therein the high voltage output part and so on is improved, thereby making it possible to improve the reliability of the ignition unit itself.

In the third place, it may be arranged such that the high voltage output terminal is accommodated in the inside of a tubular cover which projects from the housing of the main unit and which opens at a leading end thereof. As a result of such an arrangement, in the state in which the conductive connection between the high voltage output terminal and the high voltage input terminal is established, it becomes possible to avoid the possibility of occurrence of the leak of electricity caused by a spark leak from the sharp end of the high voltage output terminal or from the sharp end of the high voltage input terminal. Especially in the case where the dividing wall to which the bracket is attached fixedly is situated in the vicinity of the high voltage output terminal or the like placed in the aforesaid conductive connection state, the occurrence of such electricity leakage is avoided effectively.

Additionally, in the case where such a tubular cover is added, it may be arranged such that the high voltage input terminal is shaped like a rod while on the other hand the high voltage output terminal has a leading end opening which receives therein the rod-shaped high voltage input terminal by the insertion engagement of the main unit, and that an inner surface of the tubular cover is shaped like a funnel the diameter of which gradually decreases from a portion thereof which opens at a greater diameter than that of the leading end opening of the high voltage output terminal to the leading end opening of the high voltage output terminal. As a result of such arrangement, even when any one of the high voltage output and input terminals or both undergo a slight displacement in an insertion engagement operation of the main unit to the bracket, it is possible to provide guidance to a conductive connection position by guiding the high voltage input terminal along over the funnel-shaped internal surface of the tubular cover. This therefore makes it possible to ensure that the conductive connection of the high voltage output terminal and the high voltage input terminal is established without fail. Because of this, the process to the mutual conductive connection of the main unit-side high voltage output terminal and the spark plug-side high voltage input terminal is guided reliably in the insert engagement of the main unit into the bracket, thereby making it possible to ensure that the conductive connection is established without fail.

In the fourth place, it may be arranged such that the ground-side connection terminal is formed of two elastic band plates which are placed one upon the other and which are bent in such a curve that their projected ends open outwardly from each other, and that the bracket has integrally formed therewith a plate terminal which extends in the insertion engagement direction and which is sandwiched between the two elastic band plates by the insertion engagement. As a result of the insertion engagement operation of the main unit into the bracket, the plate terminal is driven between the projected ends of the two elastic band plates making up the ground-side connection terminal, thereby ensuring that the conductive connection therebetween is established without fail, with the plate terminal fastened between the two elastic band plates by the action of elastic resilience. Besides, it is arranged such that the projected ends are bent so as to open outwardly from each other, so that, even when the ground-side connection terminal and the plate terminal are slightly displaced from each other in the insertion engagement operation, guidance to the conductive connection position is provided without fail and, as a result, the conductive connection is established. Because of this, in mounting the main unit onto the bracket by an insertion engagement operation, the guidance to the conductive connection of the ground-side connection terminal and the maintenance of the conductive connection are ensured more definitely.

DETAILED DESCRIPTION OF THE PREFERRED EMBODIMENTS

Hereinbelow, embodiments of the present invention will be described with reference to the drawings.

Figure 1:
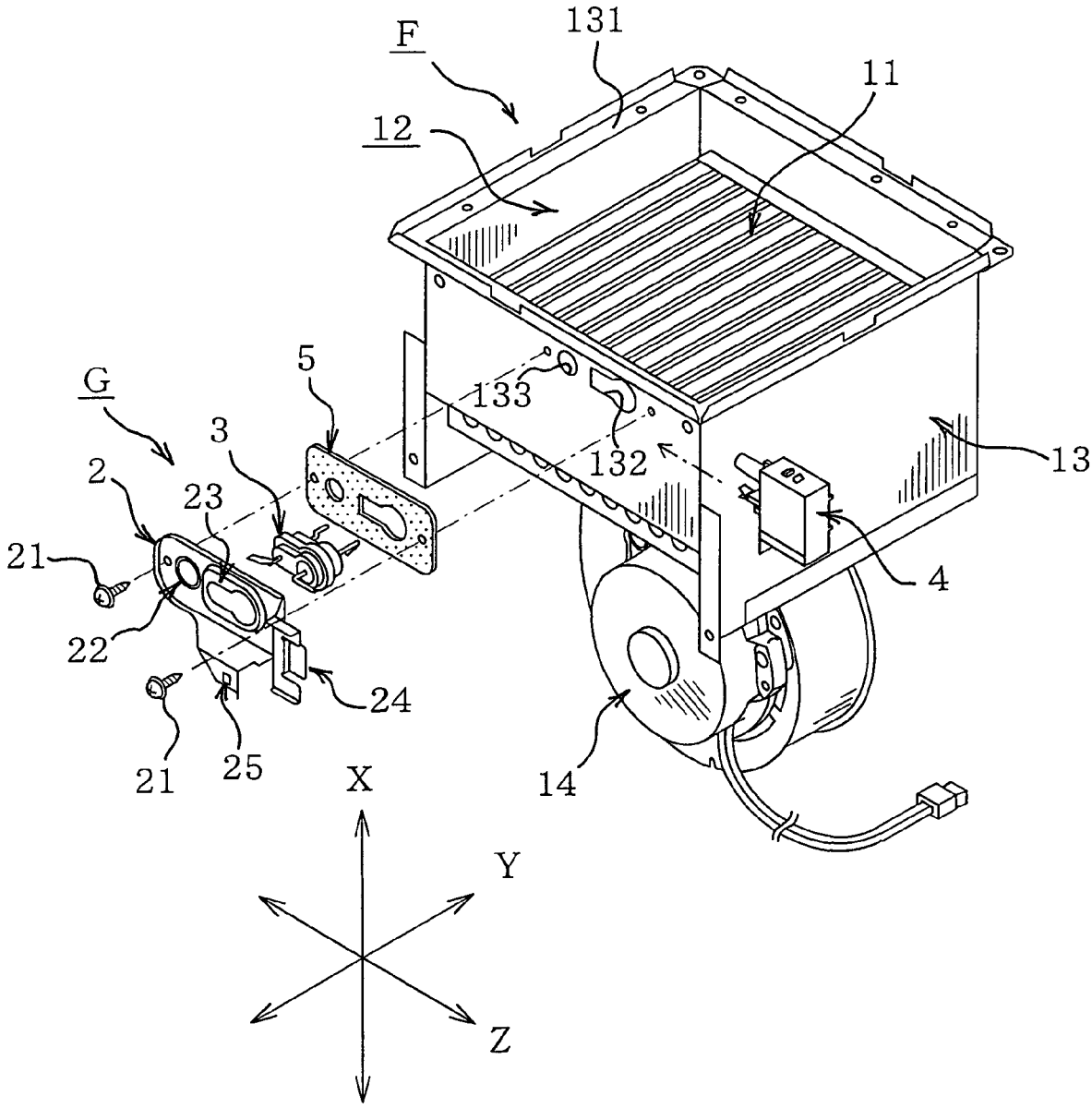
FIG. 1 is a perspective view illustrating in an exploded manner an example of an embodiment of the present invention when being attached to a burning appliance.

Referring to FIG. 1, there is shown an exploded perspective illustration of an ignition unit G of the present invention which is incorporated into a combustion system F for hot water supply equipment. This combustion system F is made up of: a combustion burner 11 formed by combustion tubes arrayed side by side in a plurality of rows; a burner case 13 which contains therein the combustion burner 11 to divisionally define a space for a combustion chamber 12 above the combustion burner 11; and an fan 14 which provides a supply of combustion air to the combustion burner 11. The combustion system F serves to heat water to a predetermined level of temperature by use of the combustion heat of the combustion burner 11 and supplies the hot water to a hot water tap or the like. More specifically, a storage water heater body (not shown in the figure) which houses therein for example a heat exchanger of the fin and tube type is fixedly joined to an upper flange 131 of the burner case 13, wherein water which is made to flow through the inside of the heat exchanger is heat-exchange heated by the heat of combustion of the combustion burner 11. In the present invention, the combustion burner 11 is a "ignition target", and the shell wall of the burner case 13 is a "dividing wall". The burner case 13 is formed of a plate of electrically conductive steel and constitutes a part of a ground-side circuit by combination with the combustion burner 11, as will be described later.

The ignition unit G is an integrated assembly of a bracket 2 which is fixed to the burner case 13 by screws 21, 21, a spark plug 3 supported by the bracket 2, and a main unit 4 whose housing (chassis) 41 contains therein a high voltage output part. In the figure, a heat-resisting gasket 5 is shown. The heat-resisting gasket 5 is put between the bracket 2 and the burner case 13, thereby blocking the transfer of heat from the burner case 13 to the bracket 2 and preventing the leakage of exhaust combustion gas. Formed through the burner case 13 are a through hole 132 of a given shape by which a spark plug 3 is arranged so as to pass therethrough, and a through hole 133 serving as an supervising window. The bracket 2 is attached in positional association with the through holes 132, 133.

Figure 2:
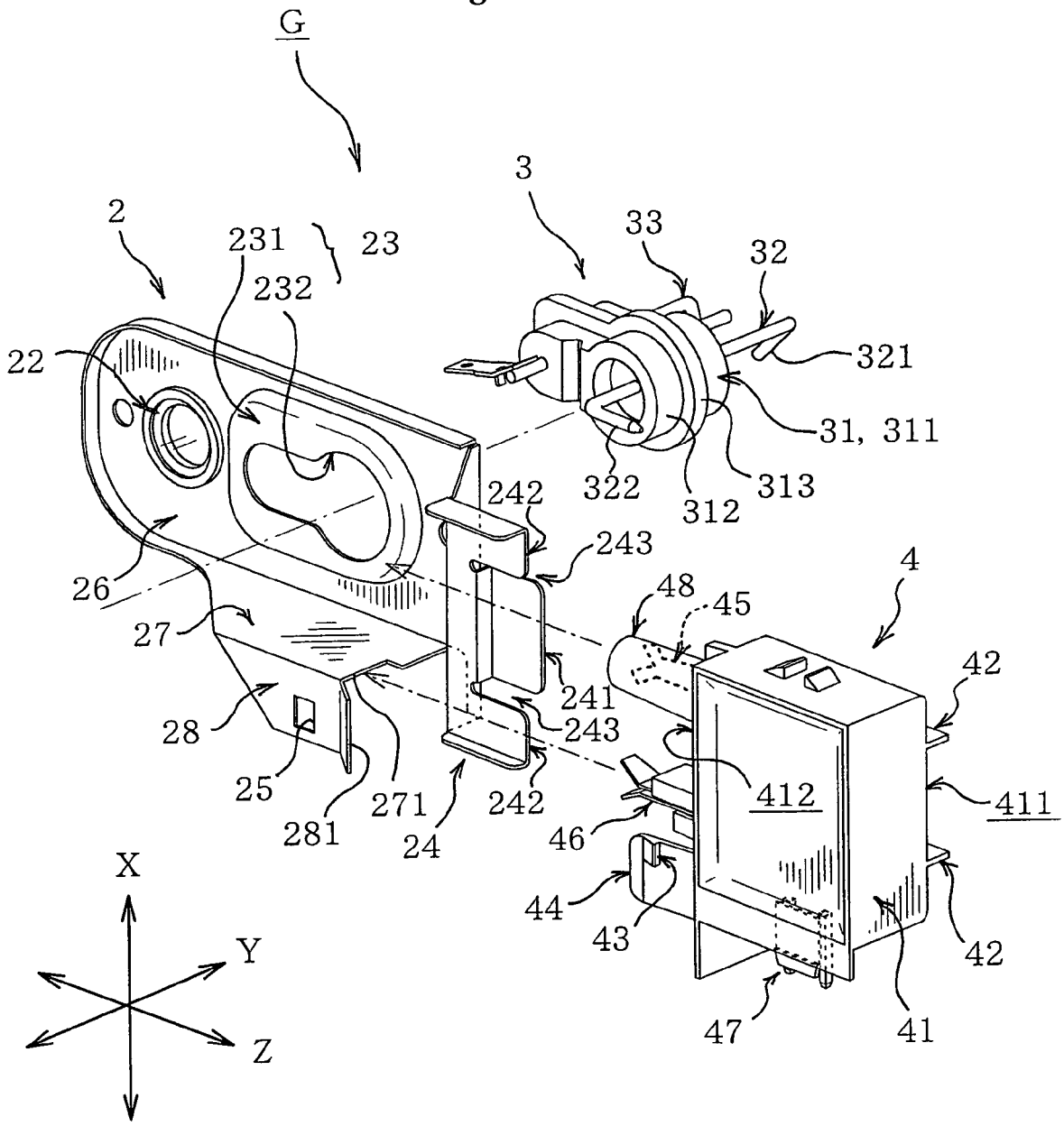
FIG. 2 is a perspective view illustrating in an exploded manner an ignition unit of the embodiment.
Figure 3:
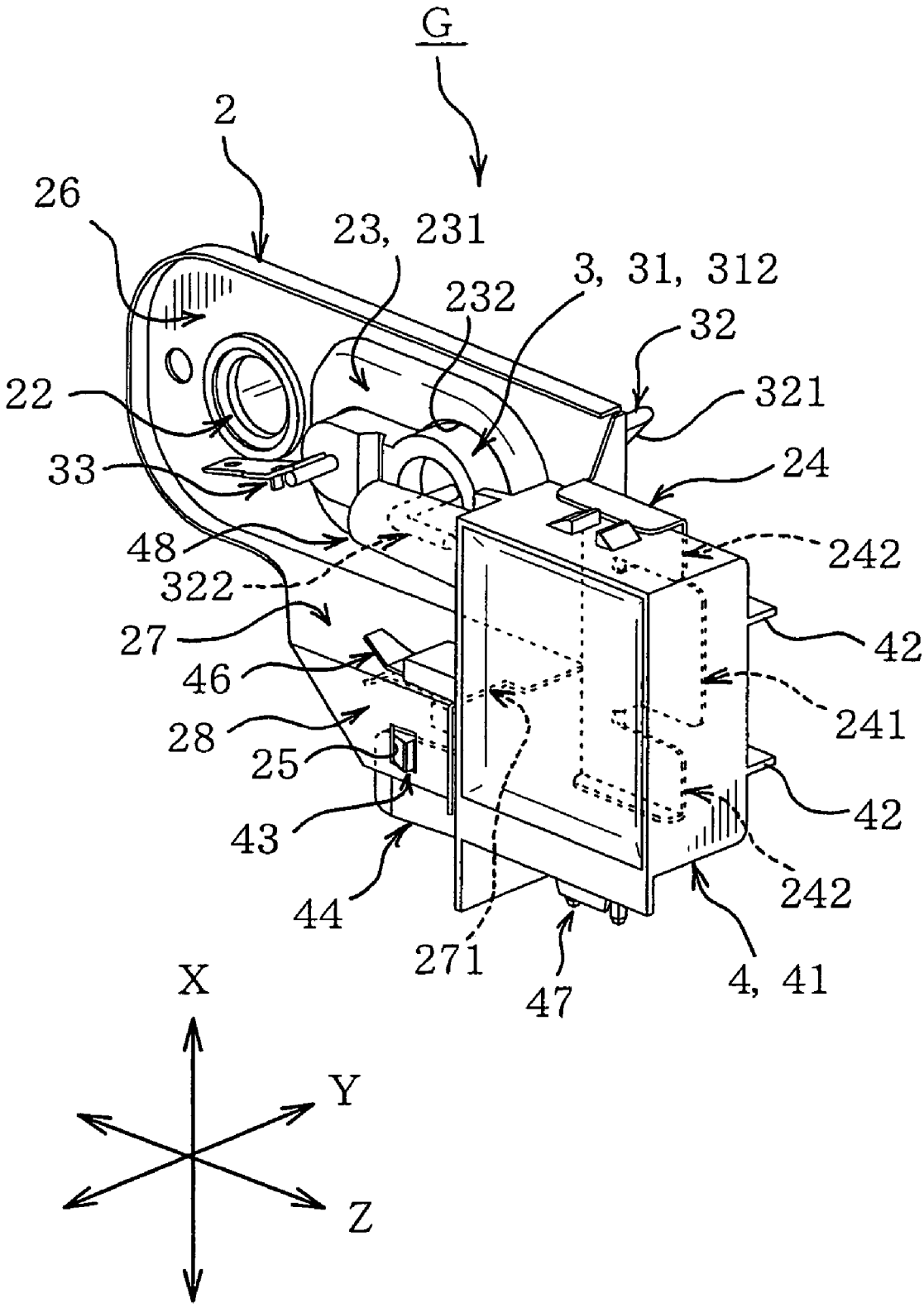
FIG. 3 is a perspective view illustrating the ignition unit of FIG. 2 in a one-piece state as a result of the assembly of its individual parts.

Hereinafter, referring mainly to FIGS. 2 and 3, each of the component parts 2, 3, 4 of the ignition unit G will be described in detail. FIG. 2 is a perspective view illustrating the ignition unit G in an exploded manner, while FIG. 3 is a perspective view illustrating the ignition unit G in a one-piece state as a result of the assembly of its individual parts. In the following description, the directions in which orthogonal three axes (X, Y, Z) extend will be used as directional references in some cases (see FIG. 1 or 2). In the figures, the X-axis direction is a vertical direction, the Y-axis direction is a front-to-rear direction, and the Z-axis direction is a horizontal direction. With respect to the axes X, Y, or Z, the same will be applied to the other figures.

Figure 4:
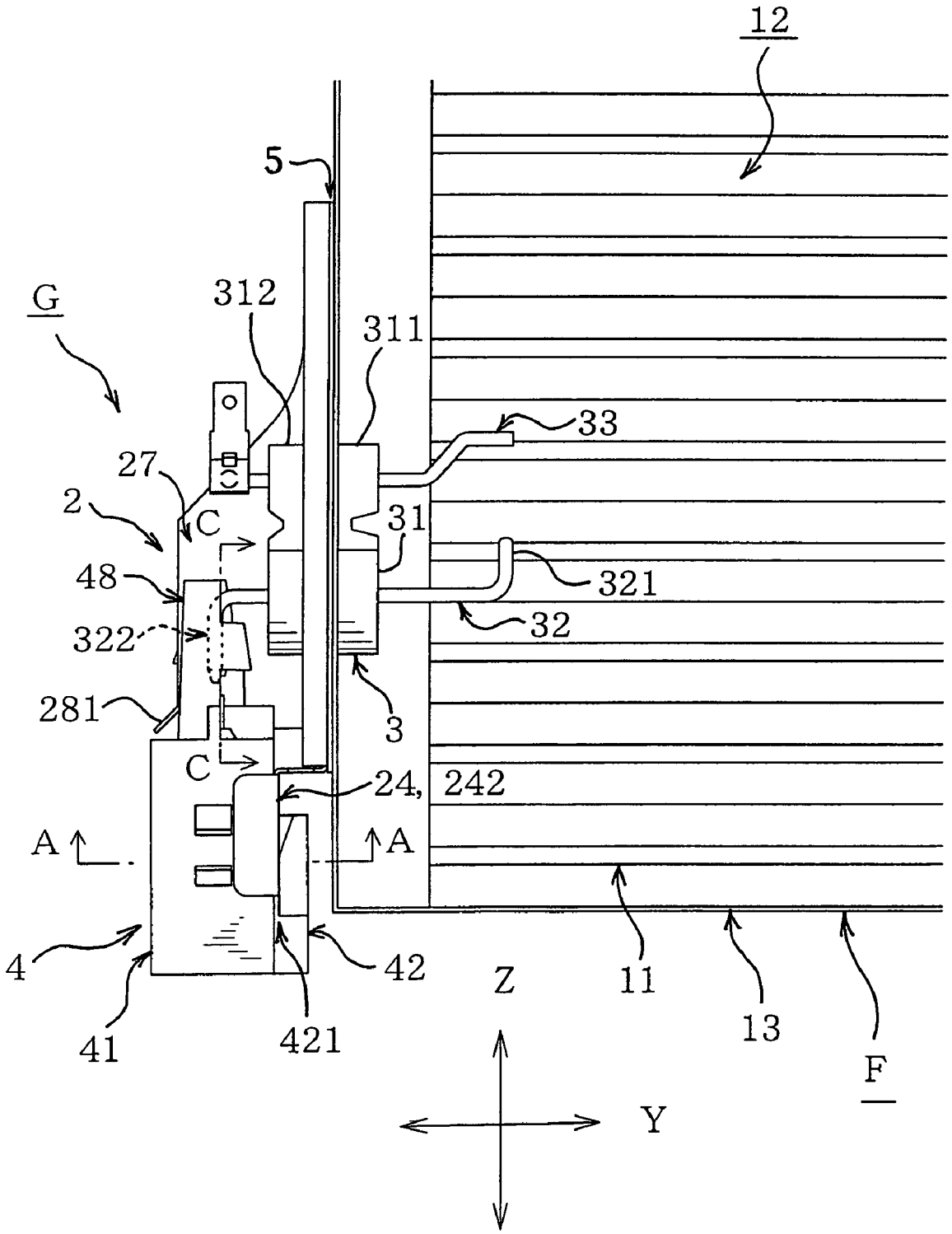
FIG. 4 is a partial top plan view of the ignition unit when attached to the burning appliance of FIG. 1.

As shown in detail in FIGS. 2 and 3, the spark plug 3 is composed of a body 31 made of insulating material such ceramic or the like, a rod-like electrode conductor 32 which passes completely through the body 31 in the Y-axis direction, and a flame rod 33 for ignition detection which passes completely through the body 31. In the present embodiment, the flame rod 33 is just provided in the same body 31 through the use of the spark plug 3. Therefore, the provision of the flame rod 33 is not essential for the spark plug 3 of the present invention. However, in accordance with the present embodiment, it is possible to install the flame rod 33 together with the spark plug 3 without making use of other special install means. The body 31 is comprised of: an internal portion 311 which is fitted into the through hole 132 of the burner case 13; an external portion 312 which is fitted into a retention hole 232 of the bracket 2 which will be described later; and a flange portion 313 which projects from the boundary position of the portions 311, 312 to the outer circumference, extending greatly beyond the through hole 132 and the retention hole 232. The flange portion 313 is for positioning and engagement with respect to the bracket 2. More specifically, by the flange portion 313 being engaged into a retention portion 23 of the bracket 2 which will be described later, the positioning of the spark plug 3 to the bracket 2 to a given retention position is determined. A leading end of the conductor 32, which is a rear side end thereof is situated in the inside of the combustion chamber 12, is bent in a curve towards the combustion burner 11, and is extended to near the combustion burner 11 to form an ignition electrode part 321, while on the other hand a base end of the conductor 32 which is a front side end thereof is situated outside the burner case 13 and is bent in a curve in a given direction (bent horizontally to be oriented to the right relative to FIGS. 2 and 3) to form a high voltage input terminal 322 (see also FIG. 4).

The bracket 2, formed by bending a metal sheet material which is an electrically conductive material, is electrically connected to the burner case 13 and to the combustion burner 11 by the screws 21, 21, whereby the bracket 2 itself constitutes a part of the ground-side circuit. The bracket 2 is provided with an supervising window 22, a retention portion 23 for supporting the body 31 of the spark plug 3, a mounting portion 24 on which to mount the main unit 4, and an engagement hole 25 for restricting the main unit 4 in the mount state. The supervising window 22 is formed by fitting a sheet of heat-resistance glass or transparent quartz into a through hole. The state of flames produced by the combustion burner 11 can be inspected from the outside through the supervising window 22. The retention portion 23 is composed of a concave part 231 into which the flange portion 313 of the body 31 of the spark plug 3 is engaged from the side of the burner case 13 and a retention hole 232 which has a hole shape corresponding to that of the outer circumference of the outer portion 312 and which opens at the bottom of the concave part 231. The supervising window 22 and the retention portion 23 are formed in a flat plate portion 26 which is fixed to the burner case 13 while being brought into close contact with the gasket 5.

The mounting portion 24 is formed as follows. That is, the mounting portion 24 is so bent in a curve from a lateral one side position (the right-hand side in FIGS. 2 and 3) of the flat plate portion 26 towards the front side as to form a step with respect to the flat plate portion 26. Because of this, the mounting portion 24 is situated at an offset position outwardly (frontwardly) spaced a given distance apart from the burner case 13, with the flat plate portion 26 fixed to the burner case 13. Such arrangement keeps the main unit 4 away from the burner case 13, thereby achieving improvement in the heat resistance of the main unit 4. In addition, a projected piece 27 which is bent in a curve from a lower edge position of the flat plate 26 and which projects for a predetermined distance towards the front side is formed in a continuous manner. Further, a flange piece 28 which is bent in a curve downwardly from a leading end position of the projected piece 27 is formed in a continuous manner. And, a plate terminal 271, which is brought into conductive contact with a ground-side connection terminal 46 of the main unit 4 which will be described later, is formed by a one side end edge of the projected piece 27 (the right-hand side end edge in FIGS. 2 and 3). In addition, an engagement hole 25 as a concave portion is formed at a predetermined position of the flange piece 28, and penetrates therethrough. A guide portion 281, which is so bent in a curve as to open diagonally outwardly, is formed, extending from the engagement hole 25 to an end portion of the flange piece 28. Together with a projected piece 44 and a convex portion 43 of the main unit 4 which will be described later, the engagement hole 25 makes up a "lock mechanism" of the present invention.

The mounting portion 24 constitutes, together with guide rails 42, 42 of the main unit 4 which will be described later, a "mount mechanism" of the present invention. The mounting portion 24 is made up of a central clamp piece 241 and outer clamp pieces 242, 242 which are located outside the central clamp piece 241 facing each other thereacross (see also FIG. 5). A slit 243 of a given width s is defined between the central clamp piece 241 and each of the outer clamp pieces 242 (see FIG. 6). On the other hand, the central clamp piece 241 is bent in a curve at the root thereof, expanding in parallel with each of the outer clamp pieces 242 at a position nearer to the burner case 13 than each of the outer clamp pieces 242.

On the other hand, in the main unit 4 the housing 41 which is made of synthetic resin for insulation and protection houses therein an electric circuit board (not shown) on which to mount electronic components such as a transformer constituting a high voltage output part. The main unit 4 has two rows of guide rails, i.e., the guide rails 42, 42, constituting a part of the mount mechanism, the projected piece 44 provided with the convex portion 43 constituting a part of the lock mechanism, a high voltage output terminal 45 operable to apply to the spark plug 3 a high voltage generated by the electric circuit board, the ground-side connection terminal 46, and an electric power supply terminal 47 for turning on the electric circuit board.

Both the guide rails 42, 42 are formed integrally with the housing 41 so that they extend in parallel with one another on a rear surface 411 of the housing 41 in the Z-axis direction, with a space of a given size defined therebetween. It is set such that the distance between the guide rails 42, 42 agrees with the width of the central clamp piece 241, i.e., the width relative to the X-axis direction (see FIG. 6). In addition, each guide rail 42 is thick over the full length thereof or has a partially thickened portion (in the present invention each guide rail 42 is thickened partially). A concave groove 421, which opens outwardly (upwardly and downwardly) at a position flush with the rear surface 411 and which extends in the Z-axis direction, is formed in the thickened portion. And, the groove width of the concave groove 421 is set to a dimension corresponding to the thickness of the end edge of each of the outer clamp pieces 242, while on the other hand the thickness of each of the guide rails 42 at the groove bottom of the concave groove 421 is set to the aforesaid width s. In addition, on the side of the bracket 2, the concave groove 421 opens in such a manner that it gradually increases in groove width for facilitating insert and engagement operation guidance (see reference numeral 422 in FIG. 7).

Figure 5:
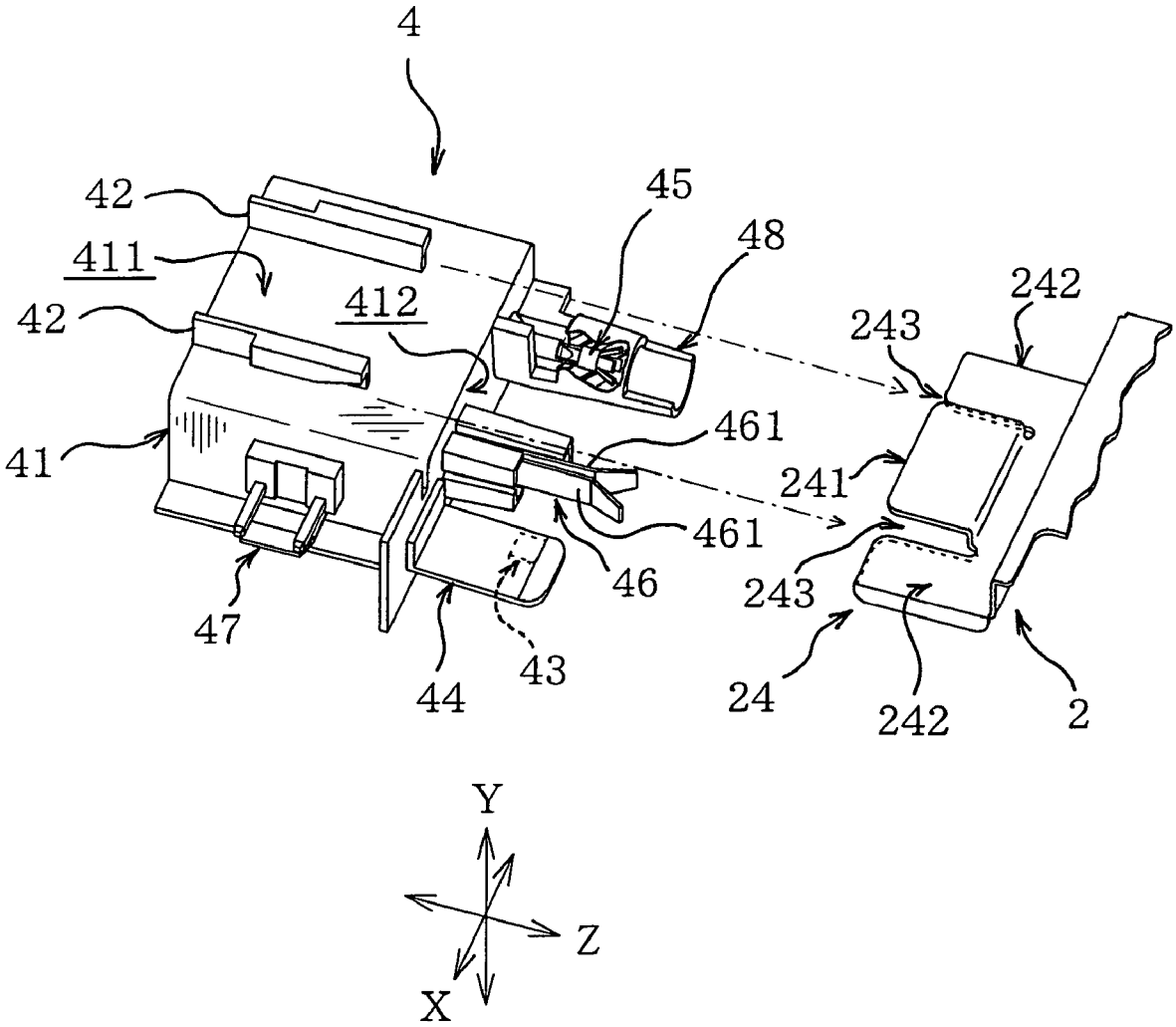
FIG. 5 is a perspective view illustrating a rear surface of a main unit when viewed from above.
Figure 6:
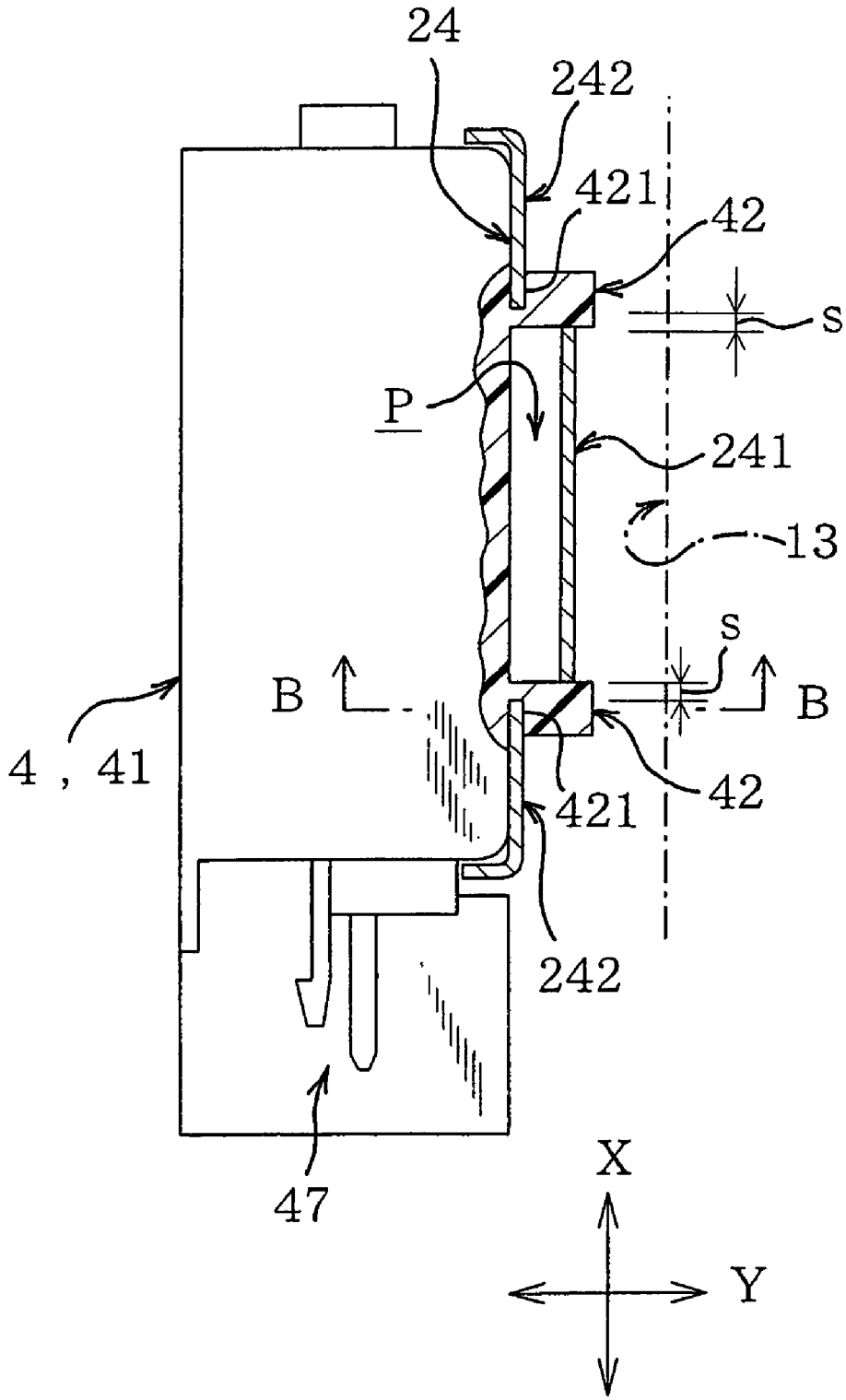
FIG. 6 is an enlarged cross-sectional explanatory view taken along line A—A of FIG. 4.
Figure 7:
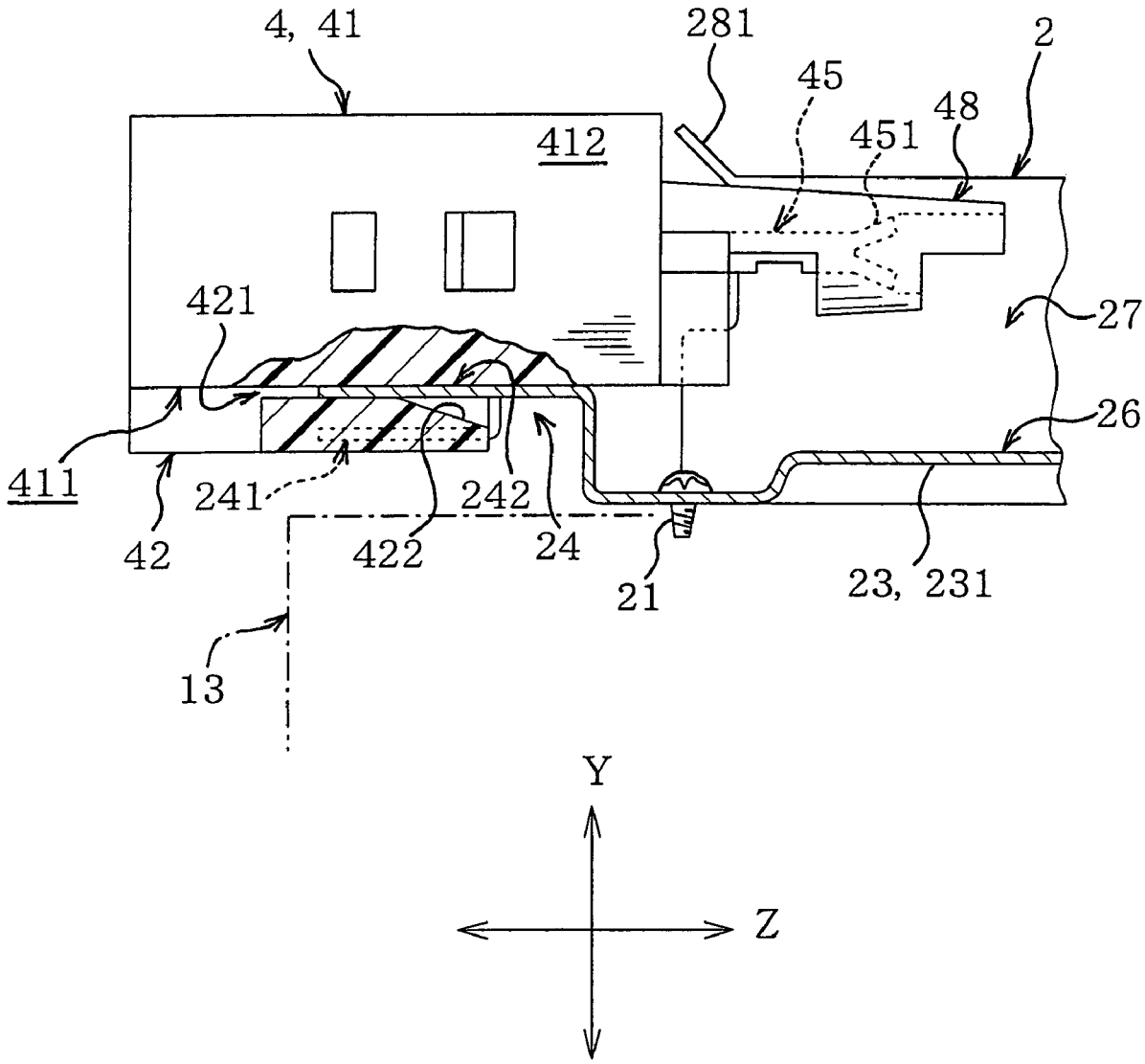
FIG. 7 is cross-sectional explanatory view taken along line B—B of FIG. 6.

Therefore, as shown in FIG. 5, the rear surface 411 of the main unit 4 is brought into abutment with the outer clamp pieces 242, 242 of the mounting portion 24 of the bracket 2. Then, when the main unit 4 is made to approach the bracket 2 in the Z-axis direction, in other words when the main unit 4 is shifted to the left, end edges of the outer clamp pieces 242, 242 are inserted and engaged into the concave grooves 421 of the guide rails 42. The main unit 4 is now mounted on the mounting portion 24 of the bracket 2, as shown in FIGS. 6 and 7. In this mount state, the one pair of the guide rails 42, 42 are placed in such a state that they are sandwiched tightly by the outer clamp pieces 242, 242 from the outside over a given length relative to the Z-axis direction, while at the same time the end edges of the outer clamp pieces 242, 242 are placed in such a state that they are closely fitted to the concave grooves 421, 421 respectively over a given length relative to the Z-axis direction. This therefore ensures that the displacement relative to the X-axis direction and the Y-axis direction is prevented from occurring, thereby enabling the housing 41 of the main unit 4 to be secured to the bracket 2. In addition, in such a mount state, both the outer clamp pieces 242, 242, although they are in an abutment relationship with the rear surface 411 of the main unit 4, covers it and, in addition, the central clamp piece 241 is spaced from the rear surface 411 of the housing 41 and is therefore placed in such a state that it covers the rear surface 411 between the guide rails 42, 42 with a space P defined between itself and the rear surface 411. Therefore, radiation heat from the burner case 13 is reflected by the central clamp piece 241 and, in addition, it is possible to insulate the radiation heat by a layer of air of the space P. Because of this, it becomes possible to achieve improvement in thermal durability by avoiding thermal influence on the main unit 4 as much as possible.

By the above-described insertion engagement operation of the main unit 4, in addition to the mounting of the main unit 4 to the bracket 2, the conductive connecting of the high voltage output terminal 45 to the high voltage input terminal 322, the conductive connecting of the ground-side connection terminal 46 to the plate terminal 271, and the engaging of the convex portion 43 of the projected piece 44 into the engagement hole 25 are all completed at the same time. More specifically, the projected piece 44, the high voltage output terminal 45 housed in the tubular cover 48, and the ground-side connection terminal 46 all project from their respective predetermined positions of a left-hand side surface 412 of the housing 41 of the main unit 4. The predetermined positions used here are those at which, when the housing 41 is mounted onto the mounting portion 24, (i) the onvex portion 43 is engaged into the engagement hole 25 while simultaneously the projected piece 44 is in abutment with a rear surface of the flange piece 28, (ii) the high voltage output terminal 45 and the high voltage input terminal 322 lie coaxially and face to face with each other in the Z-axis direction; and (iii) the plate terminal 271 lies between a pair of elastic band plates 461, 461 (see FIG. 5) which together constitute the ground-side connection terminal 46 with respect to the Z-axis direction. By virtue of such a positional arrangement, with the aforesaid insert engagement of the main unit 4 into the bracket 2, the conductive connecting of the high voltage output terminal 45 and the high voltage input terminal 322, the conductive connecting of the ground-side connection terminal 46 and the plate terminal 271, and the engaging between the convex portion 43 and the engagement hole 25 are all completed at the same time that the main unit 4 is mounted integrally onto the bracket 2.

The convex portion 43, the high voltage output terminal 45, and the ground-side connection terminal 46 will be described in detail. Preferably both the convex portion 43 and the projected piece 44 are made of material capable of exerting elastic resilience; for example, they may be made of synthetic resin and be formed integrally with the housing 41. Alternatively, it may be arranged such that they are formed of synthetic resin or the like as a separate body and are adhered to the housing 41. The left side of the convex portion 43 forms a slope while the right side thereof is provided with a stepped portion. As a result of such arrangement, when the convex portion 43 is engaged into the engagement hole 25, the stepped portion of the convex portion 43 engages with the hole edge of the engagement hole 25. In other words, the position of the main unit 4 to the bracket 2 with respect to the Z-axis direction is determined by the engagement. Once the engagement is established, the rightward difference movement of the main unit 4 is prevented, in other words the engagement functions to prevent the main unit 4 from slipping off from the engagement hole 25. In addition, if the projected piece 44 exerts elastic resilience, this causes elastic resilience to act on the flange piece 28 by causing the projected piece 44 to get into the rear surface side of the flange piece 28, thereby making it possible to further enhance the integration of the main unit 4 with the bracket 2.

Figure 8:
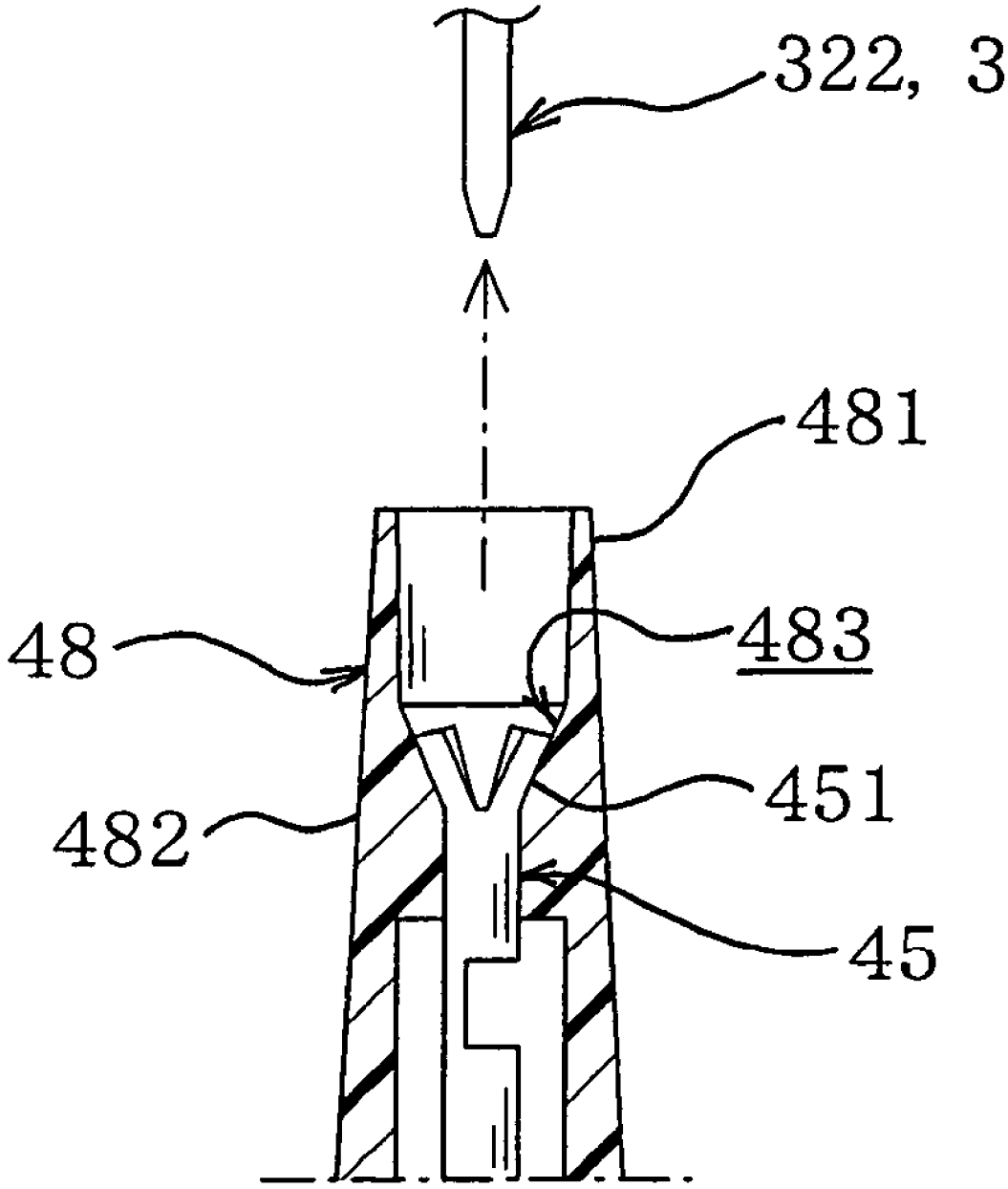
FIG. 8 is an enlarged cross-sectional explanatory view taken along line C—C of FIG. 4.

In addition, the high voltage output terminal 45 is formed by a tubular terminal having a leading end 451 which opens like a trumpet or funnel for receiving the rod-shaped high voltage input terminal 322, as shown in FIG. 8. And, the tubular cover 48 houses therein the high voltage output terminal 45 and shields the whole or a part of the high voltage output terminal 45. In the present embodiment, as the tubular cover 48, there is shown one that is provided with a leading end 481 having a semicircular cross-sectional shape and a lateral given range portion 482 having a circular cross-sectional shape including the leading end 451 of the high voltage output terminal 45. In other words, at least the leading end 451 of the high voltage output terminal 45 is shielded. Because of such arrangement, the occurrence of a leak of electricity from the leading end 451 to the burner case 13 caused by spark leakage or the like is prevented. In addition, an inner surface 483 of the tubular cover 48 extending to the leading end 451 is shaped like a funnel so that the diameter gradually decreases towards the leading end 451. This therefore reliably guides the high voltage input terminal 322 to engage into the high voltage output terminal 45, at the time of the insertion engagement of the main unit 4.

Furthermore, the ground-side connection terminal 46 is formed by the pair of elastic band plates 461, 461 which are placed one upon the other and the elastic band plates 461, 461 have projected ends which are so bent in a curve as to spread outwardly from each other for providing guidance for the entrance of the plate terminal 271 between the elastic band plates 461, 461. And, the plate terminal 271 is inserted between the elastic band plates 461, 461 by said insertion engagement operation, as a result of which the plate terminal 271 is sandwiched tightly between the elastic band plates 461, 461, with elastic resilience acting thereon.

The above-described ignition unit G is attached to the combustion system F as follows. In the first place, with the spark plug 3 supported by the retention portion 23 of the bracket 2, the bracket 2 is attached to the burner case 13 by the screws 21, 21. At this time, the spark plug 3 is inserted, through the gasket 5, into the through hole 132. In the next place, the main unit 4 is mounted onto the mounting portion 24 of the bracket 2 by an insertion engagement operation, whereby the integration of the main unit 4 and the bracket 2, the conductive connection between the high voltage output terminal 45 and the high voltage input terminal 322, and the conductive connection between the ground-side connection terminal 46 and the plate terminal 271 are all completed by the mounting and lock mechanisms in a single work operation. In other words, the integration of the main unit 4 and the bracket 2 and both of the conductive connection between the high voltage output terminal 45 and the high voltage input terminal 322 and the conductive connection between the ground-side connection terminal 46 and the plate terminal 271 are completed by a single assembly operation.

It should be noted that the present invention is not limited to the above-described embodiments. The present invention includes other various embodiments. Stated another way, in the above-described embodiment the central clamp piece 241 is provided mainly for the purpose of heat shield and heat insulation, which is not essential in the mounting mechanism because in the mounting and assembling operations the outer clamp pieces 242, 242 mainly take charge of guidance and position retention. On the contrary, it may be arranged such that the provision of the outer clamp pieces 242, 242 is omitted and the mounting mechanism is made up of the central clamp piece 241 alone. In this case, it suffices if a concave groove is so formed as to open on the opposite side to each guide rail 42 and both side end edges of the central clamp piece are fitted into the concave grooves.

The conductive connection between the high voltage output terminal 45 and the high voltage input terminal 322 and the conductive connection between the ground-side connection terminal 46 and the plate terminal 271 should not be in any way limited to those depicted in the figures. Stated another way, any type of connection method may be employed as long as it provides conductive connections by the inserting of the main unit 4 from the Z-axis direction.

What is claimed is:

1. An ignition unit comprising: a bracket which is fixed to a dividing wall constituting a pan of an ignition target; a spark plug which is supported by said bracket so as to penetrate through said dividing wall and which ignites said ignition target by a spark discharge; and a main unit which has a housing containing therein a high voltage output part for said spark discharge and which is mounted onto said bracket, wherein said bracket is made of an electrically conductive material so as to constitute, together with said dividing wall, a part of a ground-side circuit from said ignition target which has received a spark discharge from said spark plug, wherein said spark plug projects to near said ignition target so that an ignition electrode part on the side of a leading end is able to issue a spark discharge to said ignition target at a position on one side through said bracket, and wherein said spark plug is supported by said bracket so that a high voltage input terminal on the side of a base end projects in a predetermined direction at a position on the other side through said bracket, wherein said main unit has a high voltage output terminal which is connected to said high voltage output pan and which projects outwardly and a ground-side connection terminal which projects in parallel with said high voltage output terminal, wherein said housing of said main unit and said bracket have sections respectively integrally formed therewith, said sections together constituting a mount mechanism for guiding an insertion operation and for holding a conductive connection state in order that both the conductive connection of said high voltage output terminal to said high voltage input terminal and the conductive connection of said ground-side connection terminal to said bracket can be established by insertion engagement of said main unit into said bracket in the projecting direction of said high voltage output terminal and said ground-side connection terminal;

wherein said housing of said main unit and said bracket have sections respectively integrally formed therewith, said sections together constituting a lock mechanism for locking said main unit and said bracket in a mount state established by said mount mechanism, wherein said lock mechanism has a convex portion which is formed in one of said housing of said main unit and said bracket and which projects in a direction orthogonal to the direction of said insertion engagement, and a concave portion which is formed in the other of said housing of said main unit and said bracket and into which said convex portion is engaged from said direction orthogonal to said insertion engagement direction, and wherein said convex and concave portions are arranged so that said convex portion reaches a position of engagement into said concave portion by said insertion engagement, and that said convex portion is placed in a state in which said convex portion is engaged into said concave portion with said main unit mounted onto said bracket by said mount mechanism.

2. The ignition unit as set forth in claim 1, wherein said concave portion is an engagement hole which is formed so as to penetrate through said bracket, wherein said convex portion is formed at a leading end side portion of a projected piece which extends and projects from said housing of said main unit in the same direction as said high voltage output terminal, wherein said projected piece is configured so that an elastic pressing force acts in a direction in which said convex portion is engaged into said engagement hole.

3. The ignition unit as set forth in claim 1, wherein said mount mechanism is provided with a guide rail which projects from an outer surface of said housing of said main unit and which extends in parallel with said insertion engagement direction, and a clamp piece which is formed in said bracket so as to slide in said insertion engagement direction along over said housing outer surface with said guide rail clamped by said clamp piece.

4. The ignition unit as set forth in claim 3, wherein said guide rail is provided with a concave groove which opens at a side surface of said guide rail and which extends in a straight line along said guide rail, wherein an end edge of said clamp piece which extends in said insertion engagement direction is engaged into said concave groove.

5. The ignition unit as set forth in claim 3, wherein said housing of said main unit is provided with two guide rails while on the other hand said bracket has a central clamp piece which is inserted between said two guide rails and two outer clamp pieces which are arranged outside said two guide rails respectively, wherein said central clamp piece is arranged so that, when said main unit is mounted onto said bracket, said guide rails are clamped between said central clamp piece and each said outer clamp piece, with said central clamp piece spaced apart from said outer surface of said housing so as to define a space therebetween.

6. The ignition unit as set forth in claim 1, wherein said high voltage output terminal is accommodated in the inside of a tubular cover which projects from said housing of said main unit and which opens at a leading end thereof.

7. The ignition unit as set forth in claim 6, wherein said high voltage input terminal is shaped like a rod while on the other hand said high voltage output terminal has a leading end opening which receives therein said rod-shaped high voltage input terminal by said insertion engagement of said main unit, wherein an inner surface of said tubular cover is shaped like a funnel the diameter of which gradually decreases from a portion thereof which opens at a greater diameter than that of said leading end opening of said high voltage output terminal to said leading end opening of said high voltage output terminal.

8. The ignition unit as set forth in claim 1, wherein said ground-side connection terminal is formed of two elastic band plates which are placed one upon the other and which are bent in such a curve that their projected ends open outwardly from each other, wherein said bracket has integrally formed therewith a plate terminal which extends in said insertion engagement direction arid which is sandwiched between said two elastic band plates by said insertion engagement.

9. The ignition unit as set forth in claim 8, wherein said bracket has a flat plate portion which is fixed to said dividing wall constituting said ignition target's part and a projected piece which is bent in a curve from said flat plate portion so as w be spaced apart from said dividing wall, wherein said plate terminal is formed by one side end edge of said projected piece.

10. The ignition unit as set forth in claim 3, wherein said bracket has a flat plate portion which is fixed to said dividing wall constituting said ignition target's part, wherein said clamp piece is bent in a curve from one side position of said flat plate portion and is provided with a stepped part so that said clamp piece is situated at an offset position spaced outwardly of said dividing wall from said flat plate portion in the fixed state to said dividing wall.

11. The ignition unit as set forth in claim 1, wherein said spark plug has a body made of an insulating material and a rod-shaped electrode conductor which penetrates through said body, wherein said ignition electrode part is formed by a leading end of said conductor, wherein said high voltage input terminal is formed by a based end of said conductor.

12. The ignition unit as act forth in claim 11, wherein said bracket is provided with a concave part into which a portion of said body of said spark plug is engaged and a retention hole, formed at the bottom of said concave part, through which a base end side of said conductor of said spark plug passes, wherein said concave part is so formed as to support said spark plug by sandwiching said spark plug between said bracket and said dividing wall constituting said ignition target's part, with said body portion engaged into said concave part.

13. The ignition unit as set forth in claim 12, wherein, in addition to said conductor, a flame rod for ignition detection is disposed penetratingly in said body of said spark plug.

14. The ignition unit as set forth in claim 1, wherein said bracket is provided with a flat plate portion which is fixed to said dividing wall constituting said ignition target's part, wherein a transparent and heat-resistance supervising window is formed in a part of said flat plate portion.

15. The ignition unit as set forth in claim 1, wherein said bracket is formed by a metal plate material, and wherein said housing of said main unit is made of a synthetic resin for insulation.

* * * * *